US008456072B2

(12) United States Patent
Berger et al.

(10) Patent No.: US 8,456,072 B2
(45) Date of Patent: Jun. 4, 2013

(54) ULTRAVIOLET ENHANCER (UVE) HOLDER

(75) Inventors: Mary Berger, Manchester, NH (US); Harold L. Rothwell, Jr., Hopkinton, NH (US)

(73) Assignee: OSRAM SYLVANIA Inc., Danvers, MA (US)

( * ) Notice: Subject to any disclaimer, the term of this patent is extended or adjusted under 35 U.S.C. 154(b) by 0 days.

(21) Appl. No.: 13/118,635

(22) Filed: May 31, 2011

(65) Prior Publication Data

US 2012/0306347 A1 Dec. 6, 2012

(51) Int. Cl.
*H01J 11/00* (2012.01)

(52) U.S. Cl.
USPC ..... 313/234; 313/318.1; 313/318.02; 439/226

(58) Field of Classification Search
CPC ..... H01J 61/34; H01J 61/827; H01J 1/14
USPC ..... 313/234, 25, 26.3, 318.01–318.12; 439/226
See application file for complete search history.

(56) References Cited

U.S. PATENT DOCUMENTS

| | | | |
|---|---|---|---|
| 4,818,915 A | 4/1989 | Zaslavsky et al. | |
| 5,122,706 A | 6/1992 | Parrott et al. | |
| 5,248,273 A | 9/1993 | Nortrup et al. | |
| 6,392,343 B1 | 5/2002 | Luijks et al. | |
| 2001/0015624 A1 | 8/2001 | Vos et al. | |
| 2003/0006705 A1 * | 1/2003 | Alderman et al. | 313/607 |
| 2004/0189212 A1 | 9/2004 | Ashida et al. | |
| 2008/0169744 A1 | 7/2008 | Fortuna et al. | |

FOREIGN PATENT DOCUMENTS

| | | |
|---|---|---|
| EP | 0967631 A1 | 12/1999 |
| EP | 2151850 A2 | 10/2010 |
| JP | 2004335457 | 11/2004 |
| JP | 3137961 | 11/2007 |

OTHER PUBLICATIONS

Japanese Paten Application (Utility Patent) , registration No. 3137961, Dec. 2007, machine translation.*
Machine translation of Japanese Utility application No. JP2004-335457, 21 pages.

* cited by examiner

*Primary Examiner* — Tracie Y Green
(74) *Attorney, Agent, or Firm* — Edward S. Podszus

(57) ABSTRACT

An ultraviolet enhancer (UVE) holder (428) may be configured to attach a UVE (424) having an outer envelope (530) to an electrical lead (420) of a lamp (400) and to retain the UVE (424) within the lamp (400) in a desired position. The UVE holder (428) may include a plurality of turns (640) comprising a first turn (642) and a final turn (644). The first and final turns (642, 644) may have a substantially similar inner diameter (D) defining a through passage (646) shaped to conformingly receive the outer envelope (530) of the UVE (424). The UVE holder (428) may further include a first leg (534) depending from the first turn (642), wherein the first leg (534) may have a first distal portion (648) remote from the first turn (642) defining a first attachment region (650) adapted for attachment to a lamp capsule electrical lead (410).

11 Claims, 5 Drawing Sheets

ULTRAVIOLET ENHANCER (UVE) HOLDER

FIELD

The present disclosure relates generally to an ultraviolet (UV) radiation starting source, or ultraviolet enhancer (UVE), for a metal halide lamp, and, more particularly, to a UVE holder.

BACKGROUND

Metal halide arc discharge lamps may have high luminous efficacy and long life and may be employed in commercial usage. In one embodiment, a metal halide arc discharge lamp may include a quartz or fused silica arc tube that is hermetically sealed within a borosilicate glass outer envelope. The arc tube, itself hermetically sealed, may have tungsten electrodes sealed into opposite ends and may contain a fill material including mercury, metal halide additives and/or a rare gas to facilitate starting. In some cases, e.g. in high wattage lamps, the outer envelope may be filled with nitrogen or another inert gas at less than atmospheric pressure. In other cases, e.g. in low wattage lamps, the outer envelope may be evacuated.

Metal halide lamps may be configured to start upon application of a high voltage between two main electrodes or to an inductive start system. Metal halide lamps which do not contain UV enhancers may require higher voltage pulses to release avalanche initiating electrons. Initiating electrons, in this manner, are believed to be released from the electrode by field emission or by field extraction from charges in shallow traps on the wall of the arc tube. However, not all sockets into which such lamps are inserted have the capacity to carry the high voltage needed to start the lamps.

Accordingly, a starting aid, also known as an ultraviolet enhancer (UVE), may be provided in such lamps. In one embodiment, a conventional UVE may include a capsule with a sealed cavity that may contain a gas or a mixture of gases, such as mercury vapor and an inert gas (argon, helium, krypton, neon, or xenon). An electrode may extend into the cavity and may provide a voltage from one of the discharge vessel electrodes. Upon application of the starting voltage, a capacitive discharge may start in the capsule and may cause the capsule to emit UV radiation, which in turn may cause the release of photoelectrons in the lamp, which in turn may lower the voltage needed to start the lamp.

In one embodiment, a metal halide lamp may include a discharge vessel in an outer bulb. The discharge vessel may have two electrodes that receive the voltage for starting the lamp. The UVE may be located within the outer bulb and connected to one of the electrodes. The UVE may be positioned close to the other electrode to allow capacitive coupling. A gas inside the UVE may be partially ionized by the capacitive coupling and may emit UV light that aids in starting the lamp.

In some applications, it may be desirable to provide a holding means configured to hold the UVE in a particular position within the lamp. Examples of lamps utilizing such holding means may be found, for example, in EP 2151850 A2 (Ishida), U.S. Patent Pub. No. 2008/0169744 (Fortuna); U.S. Pat. No. 6,392,343 (Luijks); U.S. Pat. No. 5,248,273 (Nortrup); U.S. Pat. No. 5,122,706 (Parrot); and U.S. Pat. No. 4,818,915 (Zaslaysky).

FIG. 1 is a side view of an exemplary metal halide discharge lamp including a UVE held in position within the lamp by a prior art holding means. Generally, the metal halide discharge lamp 100 may include a lamp envelope 102 and a base 104 fixed at one end of the envelope 102. As shown, the base 104 may be formed for easy connection to an electrical source. Contained within the interior space of the lamp envelope 102 is a mount assembly. The mount assembly may include a light source, lamp capsule, or arc tube 106, a shroud 108, and a mounting frame 110. In the illustrated embodiment, the arc tube 106 may be positioned within the shroud 108, wherein the arc tube 106 and shroud 108 may be supported within the envelope 102 by the mounting frame 110.

As shown, the arc tube 106 may include first and second electrodes 112, 114. The mounting frame 110 may be non-insulated and electrically conductive and may serve as a first electrical lead, wherein a first conductive wire 116 may electrically connect a portion of the electrically conductive mounting frame 110 to the first electrode 112 of the arc tube 106. Additionally, a second conductive wire 118 may electrically connect the second electrode 114 of the arc tube 106 to a second lead 120. A portion of the mounting frame 110 and the second lead 120 pass through a lamp stem portion 122 at the base 104.

As shown, the electrically conductive mounting frame 110 and the second lead 120 are electrically connected to the base 104 external of the envelope 102 and are configured to provide energization of the lamp 100, specifically the arc tube 106. In other words, electrical energy may be coupled to the arc tube 106 through the base 104, second lead 120, mounting frame 110 and first and second conductive wires 116, 118. The arc tube 106 may contain a chemical fill or dose of materials to provide light when an arc is initiated therein, as is known.

The lamp 100 may further include a starting aid, or UVE 124, disposed within the lamp envelope 102. The UVE 124 may be electrically connected to at least the second lead 120 of the lamp 100 via a UVE electrical lead 126 extending from the UVE 124. Additionally, the lamp 100 may include a holding means 128 configured to hold the UVE 124 in a desired position within the lamp envelope 102, wherein a portion of the holding means 128 is coupled to a portion of the mounting frame 110.

FIG. 2 is an enlarged partial side view of the lamp of FIG. 1 showing the UVE 124 held in position by the prior art holding means 128 and FIG. 3 is a sectional view taken along line 3-3 of FIG. 2. Referring to FIG. 2, the UVE 124 may include an envelope 230 and an electrode 232 sealed within the envelope 230. The electrode 232 may be coupled to the UVE electrical lead 126, and coupled to the second lead 120. Other details relating to the UVE 124 are disclosed in at least the '915 patent identified above. Referring to FIGS. 2 and 3, the prior art holding means 128 may include a single strip of metal foil wrapped around the envelope 230 of the UVE 124. The foil strip 128 may include a first leg 234 and a second leg 236 disposed at opposite ends of the strip 128. During manufacturing, at least the first leg 234 of the foil strip 128 is coupled to a portion of the mounting frame 110 by a first weld 238. Additionally, in order to hold the UVE 124, the foil strip 128 may include a flexible material, such as nickel, thereby allowing the strip 128 to be bent and shaped around the UVE 124. Upon wrapping the foil strip 128 around the UVE 124, the second leg 236 may be coupled to a portion of the foil strip 128 by a second weld 240 in order to secure the UVE 124.

In many applications, it may be desirable for the UVE to be securely and accurately placed in a certain position within a metal halide lamp. The current UVE holding means, such as the foil strip described above, have flaws in structure and/or function. For example, in regards to the foil strip described above, during manufacturing, the required close proximity of the foil strip around the glass envelope of the UVE may result in glass damage and/or breakage when the strip is wrapped around the UVE. Additionally, construction of the UVE foil strip holder may require at least two coupling points, such as the first and second welds. This may increase assembly time and manufacturing costs, as well as chance of error with regard to welding points.

BRIEF DESCRIPTION OF THE DRAWINGS

Features and advantages of the claimed subject matter will be apparent from the following detailed description of embodiments consistent therewith, which description should be considered with reference to the accompanying drawings, wherein:

DETAILED DESCRIPTION

In general, this disclosure provides a UVE holder. The UVE holder may be configured to attach a UVE having an outer envelope to an electrical lead of a lamp and to retain the UVE within the lamp in a desired position. The UVE holder may include a plurality of turns comprising a first turn and a final turn. The first and final turns may have a substantially similar inner diameter defining a through passage shaped to conformingly receive the outer envelope of the UVE. The UVE holder may further include a first leg depending from the first turn, wherein the first leg may have a first distal portion remote from the first turn defining a first attachment region adapted for attachment to a lamp capsule electrical lead.

A UVE holder consistent with the present disclosure is configured to provide a more secure fit with less chance of UVE damage and/or breakage when compared with current UVE holders. Additionally, a UVE holder consistent with the present disclosure provides a minimum number of components and/or coupling points, resulting in less time required for assembly and less manufacturing costs.

Figure 1:
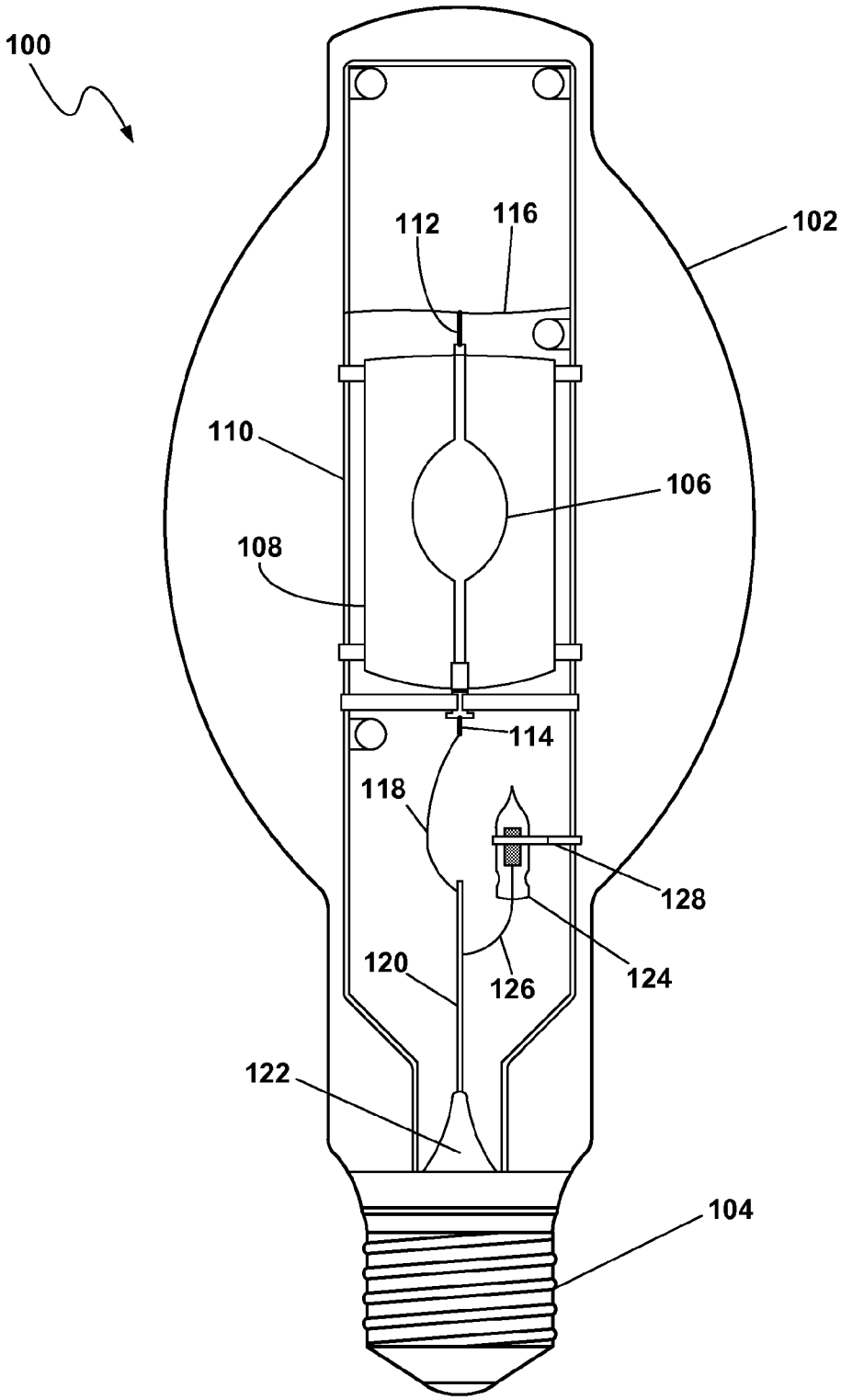
FIG. 1 Prior Art
FIG. 1 is a side view of a metal halide discharge lamp including a UVE held in position within the lamp by a prior art holding means.
Figure 2:
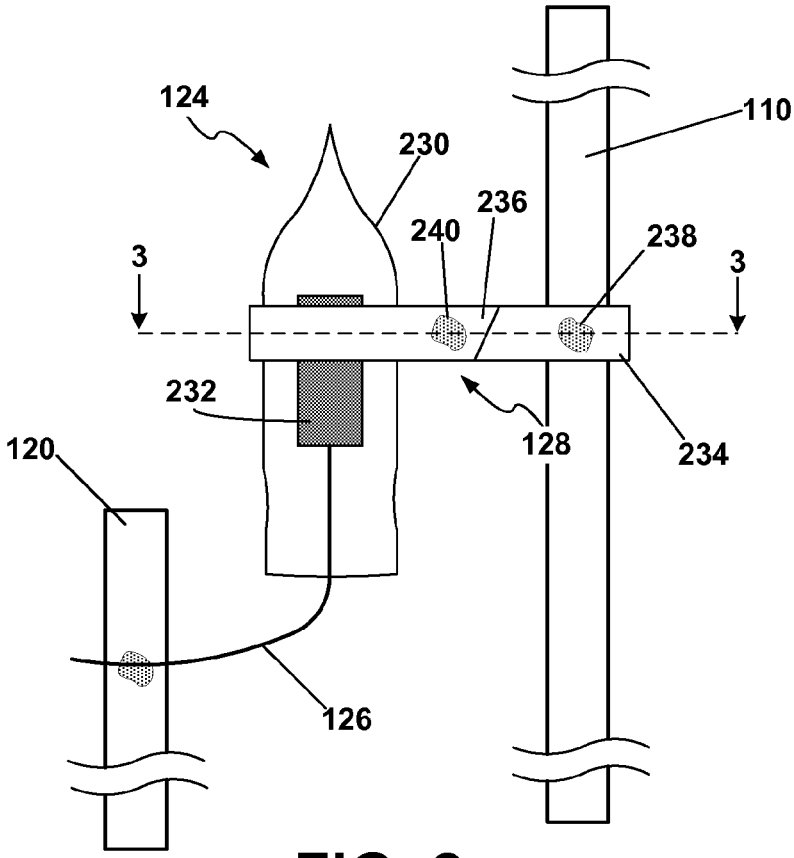
FIG. 2 Prior Art
FIG. 2 is an enlarged partial side view of the lamp of FIG. 1 showing the UVE held in position by the prior art holding means.
Figure 3:
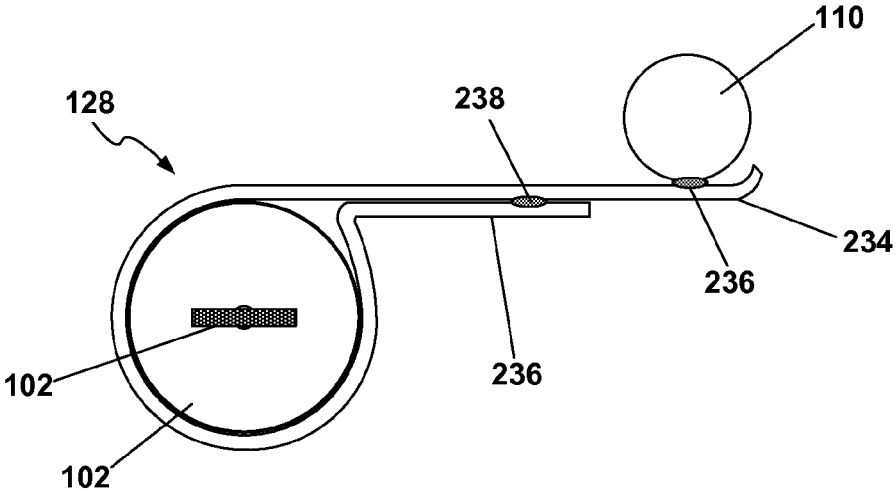
FIG. 3 Prior Art
FIG. 3 is a sectional view taken along line 3-3 of FIG. 2.
Figure 4:
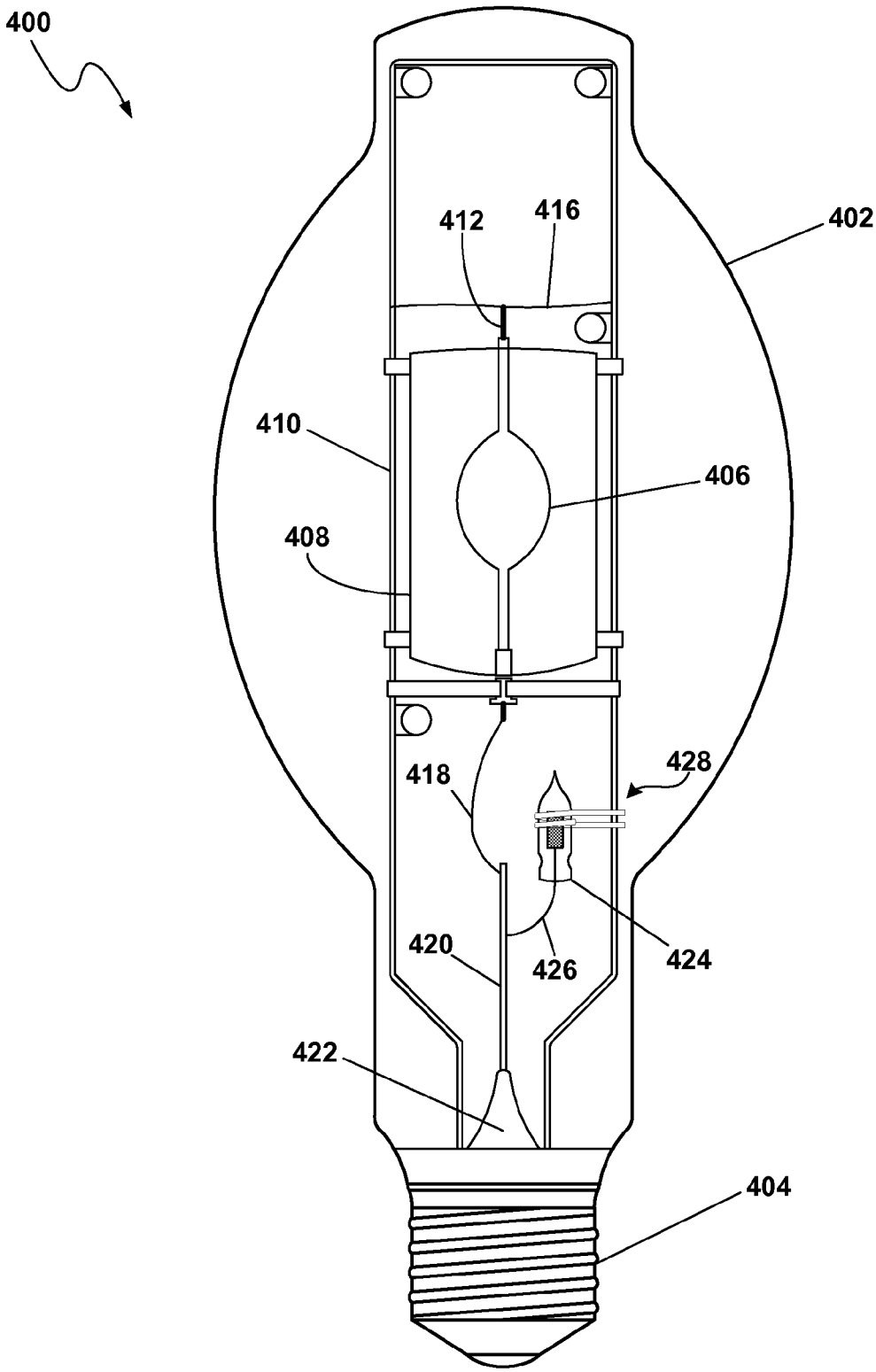
FIG. 4 is a side view of a metal halide discharge lamp including a UVE held in position within the lamp by a UVE holder consistent with the present disclosure.

FIG. 4 is a side view of a metal halide discharge lamp including a UVE held in position within the lamp by a UVE holder consistent with the present disclosure. These embodiments of the metal halide discharge lamp and UVE are similar to the embodiments of FIG. 1, and like components have been assigned like reference numerals in the four hundreds rather than the one hundreds.

Generally, the metal halide discharge lamp 400 may include a lamp envelope 402 and a base 404 fixed at one end of the envelope 402. As shown, the base 404 may be formed for easy connection to an electrical source. Contained within the interior space of the lamp envelope 402 is a mount assembly. The mount assembly may include a light source, lamp capsule, or arc tube 406, a shroud 408, and a mounting frame 410. In the illustrated embodiment, the arc tube 406 may be positioned within the shroud 408, wherein the arc tube 406 and shroud 408 may be supported within the envelope 402 by the mounting frame 410.

The lamp 400 may include a first electrical lead 420 extending from a portion of the base 404. Additionally, the mounting frame 410 may be non-insulated and electrically conductive and may serve as a second electrical lead, or lamp capsule lead, of the lamp 400. As shown, the arc tube 406 may include first and second electrodes 412, 414, wherein a first conductive wire 416 may electrically connect a portion of the electrically conductive mounting frame 410 to the first electrode 412 of the arc tube 406. Additionally, a second conductive wire 418 may electrically connect the second electrode 414 of the arc tube 406 to the first electrical lead 420. A portion of the mounting frame 410 and the first lead 420 pass through a lamp stem portion 422 at the base 404.

As shown, the first electrical lead 420 and the electrically conductive mounting frame 410 (second electrical lead) are electrically connected to the base 404 external of the envelope 402 and are configured to provide energization of the lamp 400, specifically the arc tube 406. In other words, electrical energy may be coupled to the arc tube 406 through the base 404, the first electrical lead 420, the mounting frame 410 (second electrical lead) and first and second conductive wires 416, 418. The arc tube 406 may contain a chemical fill or dose of materials to provide light when an arc is initiated therein, as is known.

The lamp 400 may further include a starting aid, or UVE 424, disposed within the lamp envelope 402. The UVE 424 may be electrically connected to at least the first electrical lead 420 of the lamp 400 via a UVE electrical lead 426 extending from the UVE 424. Additionally, the lamp 400 may include a UVE holder 428 configured to hold the UVE 424 in a desired position within the lamp envelope 402, wherein a portion of the UVE holder 428 is coupled to a portion of the mounting frame 410.

Figure 5:
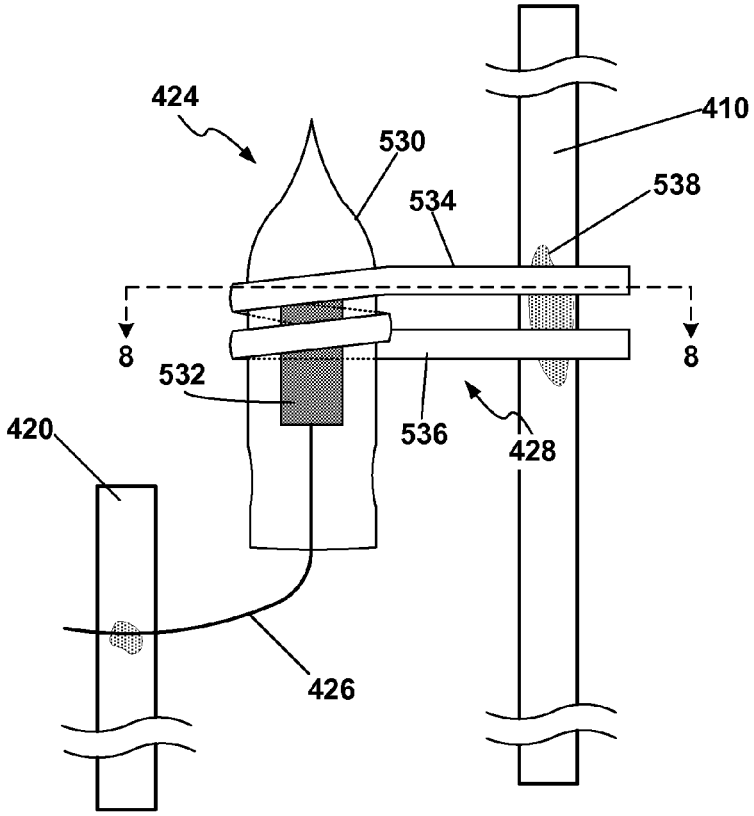
FIG. 5 is an enlarged partial side view of the lamp of FIG. 4 showing the UVE held in position by the UVE holder.
Figure 6:
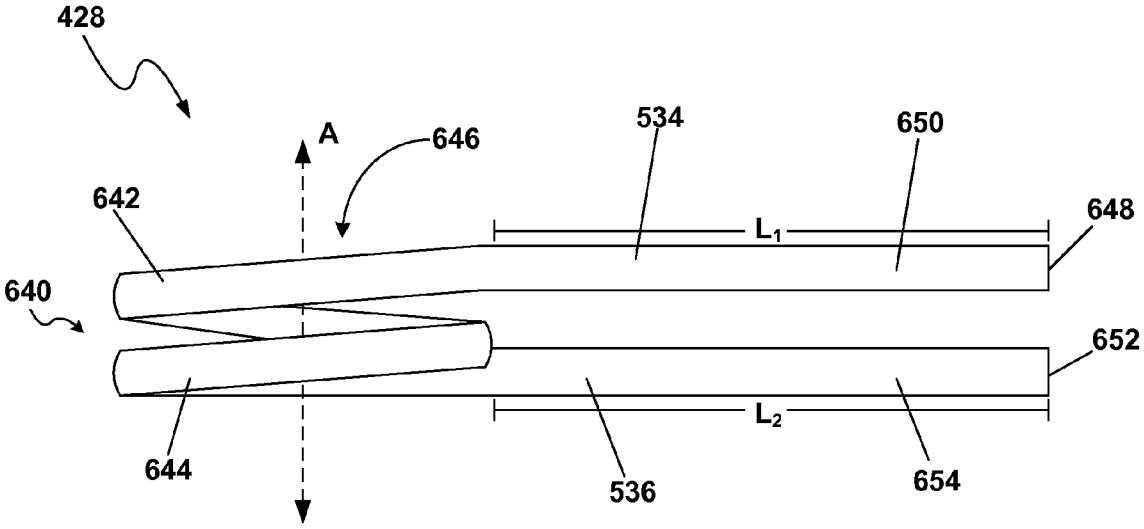
FIG. 6 is an enlarged side view of the UVE holder of FIG. 4.
Figure 7:
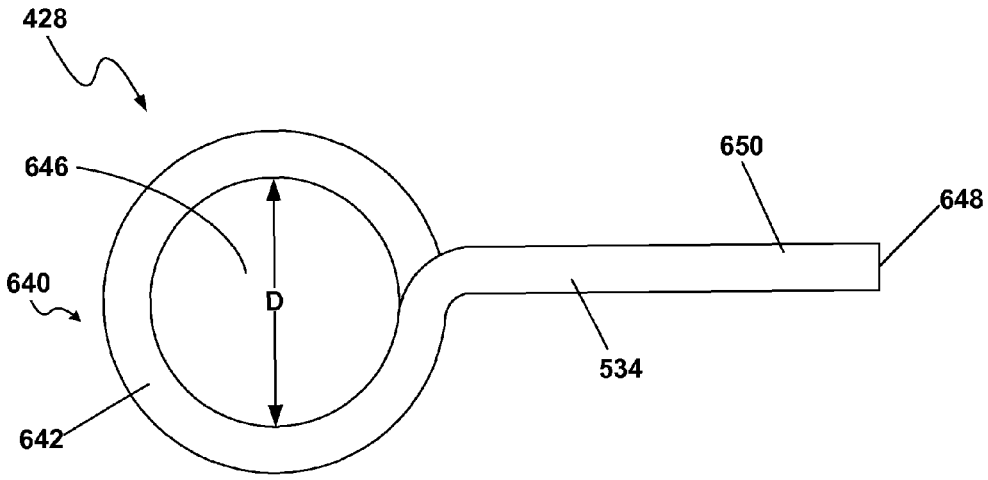
FIG. 7 is an enlarged top view of the UVE holder of FIG. 4.

FIG. 5 is an enlarged partial side view of the lamp 400 of FIG. 4 showing the UVE 424 held in position by the UVE holder 428. FIGS. 6 and 7 are enlarged side and top views of the UVE holder 428 of FIG. 4. Referring to FIG. 5, the UVE 424 may include an outer envelope 530 and an electrode 532 sealed within the outer envelope 530. The electrode 532 may be coupled to the UVE electrical lead 426 and further coupled to the first electrical lead 420 by way of the UVE electrical lead 426. The UVE holder 428 may include a single continuous wire formed into a plurality of turns including at least a first turn and a final turn (shown in FIG. 6) configured to receive the outer envelope 530 of the UVE 424, wherein a first leg 534 and a second leg 536 depend from the first and final turns, respectively. At least a portion of the first leg 534 may be coupled to at least a portion of the mounting frame 410. In the illustrated embodiment, at least a portion of the first leg 534 may be coupled to at least a portion of the mounting frame 410 (second electrical lead) via a single weldment 538.

Referring to FIG. 6, the UVE holder 428 may include a single continuous wire formed into a plurality of turns 640, wherein the plurality of turns 640 may include at a first turn 642 and a final turn 644. In the illustrated embodiment, the plurality of turns 640 may include only two turns, the first turn 642 and a second turn 644. The plurality of turns 640 may define a through passage 646 shaped and/or sized to conformingly receive at least a portion of the outer envelope 530 of the UVE 424.

A first leg 534 may depend from the first turn 642 and a second leg 536 may depend from the second turn 644. The first leg 534 may have a first distal portion 648 remote from the first turn 642, the first distal portion 648 defining a first attachment region 650 adapted for attachment to at least a portion of the mounting frame 410 (second electrical lead).

Similarly, the second leg 536 may have a second distal portion 652 remote from the second turn 644 and adjacent the first distal portion 648 of the first leg 534. The second distal portion 652 may define a second attachment region 654 adapted for attachment to at least a portion of the mounting frame 410 (second electrical lead). Additionally, the second attachment region 654 may be adapted for attachment to the first distal portion 648 and/or the first attachment region 650 of the first leg 534. The through passage 646 may define a substantially longitudinal axis A, wherein the first and second legs 534, 536 are substantially perpendicular to axis A. The first leg 534 may have a first length $L_1$ and the second leg 536 may have a second length $L_2$, wherein $L_1$ may be approximately equal to $L_2$.

Figure 8:
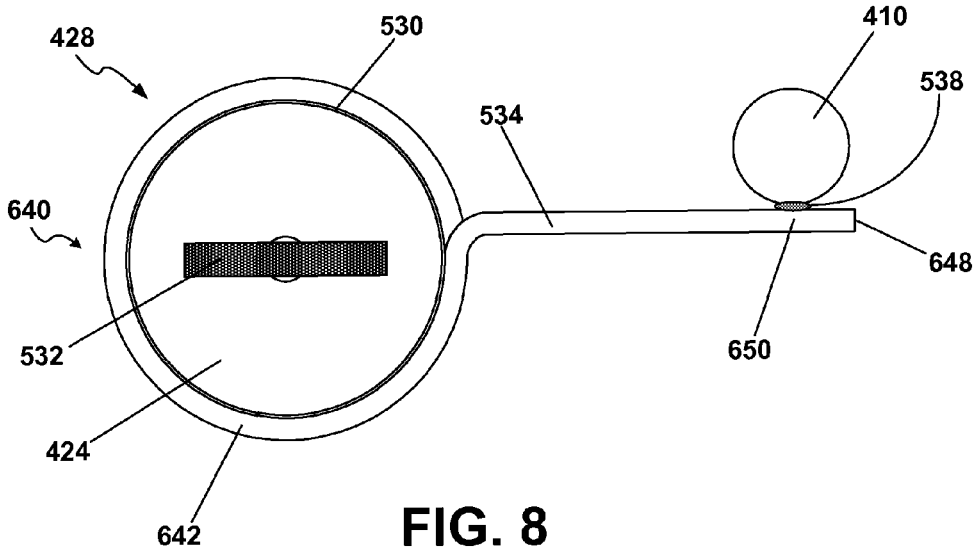
FIG. 8 is a sectional view taken along line 8-8 of FIG. 5.

As shown in FIG. 5 and FIG. 8, the second attachment region 654 of the second leg 536 may be coupled to the mounting frame 410 via the single weldment 538. In other embodiments, the second attachment region 654 of the second leg 536 may be coupled to the mounting frame 410 at approximately the same location where the first attachment region 650 of the first leg 534 is attached.

As shown in FIG. 7, each of the plurality of turns 640, including the first turn 642 and the final turn 644, have a substantially similar inner diameter D. The inner diameter D defines the through passage 646. FIG. 8 is a sectional view taken along line 8-8 of FIG. 5. As shown in FIG. 8, at least a portion of the outer envelope 530 of the UVE 424 is disposed within the through passage 646 defined by the plurality of turns 640.

The UVE holder 428 may include a single continuous wire, wherein the wire may include a flexible, resilient, and durable material configured to be bent and/or shaped into a desired dimension, such as the plurality of turns 640, as described earlier. The material may include molybdenum, for example. In one embodiment, the molybdenum wire may have a nominal 0.3 weight percent of $La_2O_3$ doping. Additionally, impurities within or on the wire should be less than 100 ppm. The wire diameter tolerance may be ±2.0%. The amount of surface carbon in one gram of molybdenum wire may not exceed 60 micrograms.

A UVE holder consistent with the present disclosure is configured to provide a more secure fit with less chance of UVE damage and/or breakage when compared with current UVE holders. For example, the second leg 536 of the UVE holder 428 may be configured to provide additional stability when torsion forces and the like are applied to the UVE holder 428 and/or UVE 424. Additionally, the plurality of turns 640 having a substantially similar inner diameter may allow a consistent and secure fit with the outer envelope 530 of the UVE 424.

Additionally, a UVE holder consistent with the present disclosure provides a minimum number of components and/or coupling points, resulting in less time required for assembly and less manufacturing costs. For example, the UVE holder 428 requires only a single weld (weldment 538) upon assembly, rather than two previously required with the prior art holding means described earlier. Additionally, the UVE holder 428 may be preformed prior to lamp assembly, rather than requiring formation during the lamp assembly process.

Consistent with one embodiment of the present disclosure, an ultraviolet enhancer (UVE) holder 428 may be configured to attach a UVE 424 having an outer envelope 530 to an electrical lead 420 of a lamp 400 and to retain the UVE 424 within the lamp 400 in a desired position. The UVE holder 428 may include a plurality of turns 640 comprising a first turn 642 and a final turn 644. The first and final turns 642, 644 may have a substantially similar inner diameter D defining a through passage 646 shaped to conformingly receive the outer envelope 530 of the UVE 424. The UVE holder 428 may further include a first leg 534 depending from the first turn 642, wherein the first leg 534 may have a first distal portion 648 remote from the first turn 642 defining a first attachment region 650 adapted for attachment to a lamp capsule electrical lead 410.

Consistent with another embodiment of the present disclosure, an ultraviolet enhancer (UVE) 424 and holder subassembly 428 may include a UVE 424 for a lamp 400, the UVE 424 having an outer envelope 530. The holder subassembly 428 may include a metal wire holder 428 for attaching the UVE 424 to an electrical lead 420 of the lamp 400. The metal wire holder 428 may include a plurality of turns 640 comprising a first turn 642 and a final turn 644. The first and final turns 642, 644 may define a through passage 646 shaped to conformingly receive the outer envelope 530 of the UVE 424, wherein the UVE outer envelope 530 may be disposed in the through passage 646. The metal wire holder 428 may further include a first leg 534 depending from the first turn 642 and a second leg 536 depending from final turn 644. The first leg 534 may have a first distal portion 648 remote from the first turn 642 defining a first attachment region 650 adapted for attachment to a lamp capsule lead 410. The second leg 536 may have a second distal portion 652 remote from the final turn 644, the second distal portion 652 extending in a similar direction to the first distal portion 648.

The following is a list of reference numeral used in the specification:

100 metal halide discharge lamp;
102 lamp envelope;
104 base;
106 arc tube;
108 shroud;
110 mounting frame (acts as first lead of lamp);
112 first electrode of arc tube;
114 second electrode of arc tube;
116 first conductive wire;
118 second conductive wire;
120 second lead of lamp;
122 lamp stem portion;
124 ultraviolet enhancer (UVE);
126 UVE electrical lead;
128 prior art holding means (nickel foil strip);
230 UVE outer envelope;
232 electrode within UVE;
234 first leg of foil strip;
236 second leg of foil strip;
238 first weld;
240 second weld;
400 metal halide discharge lamp;
402 lamp envelope;
404 base;
406 arc tube;
408 shroud;
410 mounting frame (acts as second electrical lead or lamp capsule lead);
412 first electrode of arc tube;
414 second electrode of arc tube;
416 first conductive wire;
418 second conductive wire;
420 first lead of lamp;
422 lamp stem portion;

424 ultraviolet enhancer (UVE);
426 UVE electrical lead;
428 UVE holder;
530 UVE outer envelope;
532 electrode within UVE;
534 first leg;
536 second leg;
538 single weldment;
640 plurality of turns;
642 first turn;
644 second turn;
646 through passage;
648 first distal portion of first leg;
650 first attachment region of first leg;
652 second distal portion of second leg;
654 second attachment region of second leg;
A axis of through passage;
D inner diameter of plurality of turns; and
$L_1$, $L_2$ lengths of first and second legs.

While several embodiments of the present disclosure have been described and illustrated herein, those of ordinary skill in the art will readily envision a variety of other means and/or structures for performing the functions and/or obtaining the results and/or one or more of the advantages described herein, and each of such variations and/or modifications is deemed to be within the scope of the present disclosure. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings of the present disclosure is/are used. Those skilled in the art will recognize, or be able to ascertain using no more than routine experimentation, many equivalents to the specific embodiments of the disclosure described herein. It is, therefore, to be understood that the foregoing embodiments are presented by way of example only and that, within the scope of the appended claims and equivalents thereto, the disclosure may be practiced otherwise than as specifically described and claimed. The present disclosure is directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Other elements may optionally be present other than the elements specifically identified by the "and/or" clause, whether related or unrelated to those elements specifically identified, unless clearly indicated to the contrary.

What is claimed is:

1. A metal wire ultraviolet enhancer (UVE) holder (428) for attaching a UVE (424) having an outer envelope (530) to an electrical lead (420) of a lamp (400), said wire UVE holder (428) comprising:

a plurality of turns (640) comprising a first turn (642) and a final turn (644);

said first and final turns (642,644) having a substantially similar inner diameter (D) defining a through passage (646) shaped to conformingly receive said outer envelope (530) of said UVE (424);

a first leg (534) depending from said first turn (642);

a second leg (536) depending from said final turn (644; and wherein said first leg (534) has a first distal portion (648) remote from said first turn (642) defining a first attachment region (650) adapted for attachment to a lamp capsule electrical lead (410);

wherein said second leg (536) has a second distal portion (652) remote from said final turn (644); and wherein said second distal portion (652) is adjacent said first distal portion (648).

2. The wire UVE holder of claim 1, wherein said plurality of turns (640) consists of two turns (642,644), said final turn (644) being a second turn (644).

3. The wire UVE holder of claim 1, wherein said second distal portion (652) defines a second attachment region (654).

4. The wire UVE holder of claim 3, wherein said second attachment region (654) is secured to at least one of said first distal portion (648) and said lamp electrical lead (420).

5. A metal wire ultraviolet enhancer (UVE) holder (428) for attaching a UVE (424) having an outer envelope (530) to an electrical lead (420) of a lamp (400), said wire (428) comprising:

a plurality of turns (640) comprising a first turn (642) and a final turn (644);

said first and final turns (642,644) having a substantially similar inner diameter (D) defining a through passage (646) shaped to conformingly receive said outer envelope (530) of said UVE (424);

a first leg (534) depending from said first turn (642); and wherein said first leg (534) has a first distal portion (648) remote from said first turn (642) defining a first attachment region (650) adapted for attachment to a lamp capsule electrical lead (410), further comprising a second leg (536) depending from said final turn (644), wherein said second leg (536) has a second distal portion (652) remote from said final turn (644), wherein said second distal portion (652) defines a second attachment region (654) adapted for attachment to said lamp capsule electrical lead (410), and wherein said second attachment region (654) is attached to said lamp capsule lead (410) at approximately a same location as said first attachment region (650) is attached.

6. The wire UVE holder of claim 1, wherein said second leg (536) and said first leg (534) have approximately equal length ($L_1$,$L_2$).

7. A lamp assembly comprising a lamp capsule (406) in combination with a wire ultraviolet enhancer (UVE) holder (428) for attaching a UVE (424) having an outer envelope (530) to an electrical lead (420) of a lamp (400), said wire UVE holder (428) comprising:

a plurality of turns (640) comprising a first turn (642) and a final turn (644);

said first and final turns (642,644) having a substantially similar inner diameter (D) defining a through passage (646) shaped to conformingly receive said outer envelope (530) of said UVE (424);

a first leg (534) depending from said first turn (642);

a second leg (536) depending from said final turn (644); and wherein said first leg (534) has a first distal portion (648) remote from said first turn (642) defining a first attachment region (650) adapted for attachment to a lamp capsule electrical lead (410); and said lamp capsule (406) in electrical connection with a first electric lead (420) and a second electrical lead (410), said first leg (534) and said second leg (536) being both attached to a same one of said first and second electrical leads (410,420), and wherein an electrical lead (426) coupled to an electrode (532) disposed within said UVE (424) is attached to the other of said first and second electrical leads (410, 420).

8. The lamp assembly of claim 7, further comprising a single weldment (538) on said first leg (534), said single weldment (538) being present on said first attachment region (650) and connecting said first leg (534) to said one of said first and second electric leads (410,420).

9. The lamp assembly of claim 7, further comprising a frame mount (410) supporting said lamp capsule (406) and defining said second electric lead (410), said first leg (534) being attached to a portion of said frame mount (410).

10. An ultraviolet enhancer (UVE)(424) and holder subassembly (428) comprising:

a UVE (424) for a lamp (400), said UVE (424) having an outer envelope (530);

a metal wire holder (428) for attaching said UVE (424) to an electrical lead (410) of said lamp (400), said wire (428) comprising:

a plurality of turns (640) comprising a first turn (642) and a final turn (644);

said first and final turns (642,644) defining a through passage (646) shaped to conformingly receive said outer envelope (530) of said UVE (424), said UVE outer envelope (530) being disposed in said through passage (646);

a first leg (534) depending from said first turn (642);

a second leg (536) depending from said final turn (644);

wherein said first leg (534) has a first distal portion (648) remote from said first turn (642) defining a first attachment region (650) adapted for attachment to a lamp capsule lead (410); and wherein said second leg (536) has a second distal portion (652) remote from said final turn (644), said second distal portion (652) extending in a similar direction to said first distal portion (648), and wherein said second distal portion (652) defines a second attachment region (654), said second attachment region (654) being secured to at least one of said first distal portion (648) and said lamp capsule lead (410).

11. The UVE and holder subassembly of claim 10 in combination with a lamp electrical lead (410), wherein a single weldment (538) joins said metal wire holder (428) to said lamp electrical lead (410), said weldment (538) being formed on said first attachment region (648).

* * * * *